US005277616A

United States Patent [19]

Harting et al.

[11] Patent Number: 5,277,616

[45] Date of Patent: Jan. 11, 1994

[54] ELECTRICAL CONNECTOR

[75] Inventors: Dietmar Harting, Espelkamp; Ralf Bokämper; Achim Brenner, both of Lübbecke; Dirk Oberhokamp, Hersord-Stedefreund, all of Fed. Rep. of Germany

[73] Assignee: Harting Elektronik GmbH, Espelkamp, Fed. Rep. of Germany

[21] Appl. No.: 9,608

[22] Filed: Jan. 27, 1993

[30] Foreign Application Priority Data

Feb. 7, 1992 [DE] Fed. Rep. of Germany ..... 4203455

[51] Int. Cl.[5] ..... H01R 4/24

[52] U.S. Cl. ..... 439/417

[58] Field of Search ..... 439/389–425

[56] References Cited

U.S. PATENT DOCUMENTS

| | | | |
|---|---|---|---|
| 3,012,219 | 12/1961 | Levin et al. . | |
| 3,573,713 | 4/1971 | Enright et al. . | |
| 3,718,888 | 2/1973 | Pasternak . | |
| 5,041,009 | 8/1991 | McCleerey | 439/417 |
| 5,069,625 | 12/1991 | Brant | 439/417 |
| 5,118,305 | 6/1992 | Hell et al. | 439/417 |

FOREIGN PATENT DOCUMENTS

| | | |
|---|---|---|
| 0102156 | 3/1984 | European Pat. Off. . |
| 1212180 | 3/1966 | Fed. Rep. of Germany . |
| 1959131 | 6/1970 | Fed. Rep. of Germany . |
| 2165906 | 7/1972 | Fed. Rep. of Germany . |

*Primary Examiner*—Joseph H. McGlynn

*Attorney, Agent, or Firm*—Jordan and Hamburg

[57] ABSTRACT

For an electrical connector for connecting insulated electrical conductors, preferably an electrical plug and socket connector, with contact elements disposed in chambers of a carrying base with cutting and insulation displacement connections for connection to the conductor, the conductors being introduced into the connector in the axial direction, relative to the contact elements, it is proposed that the conductors be pressed by means of a conductor guiding element, which is constructed as a pressure part, into the cutting and insulation displacement connections. At the same time, the conductors are pushed through a guiding borehole, in which they are deflected in such a manner, that they are guided obliquely through a recess in the conductor guiding element. When the carrying base and the conductor guiding element are joined together, the cutting and insulation displacement connections dip into these recesses and, in so doing, are connected with the conductors.

11 Claims, 3 Drawing Sheets

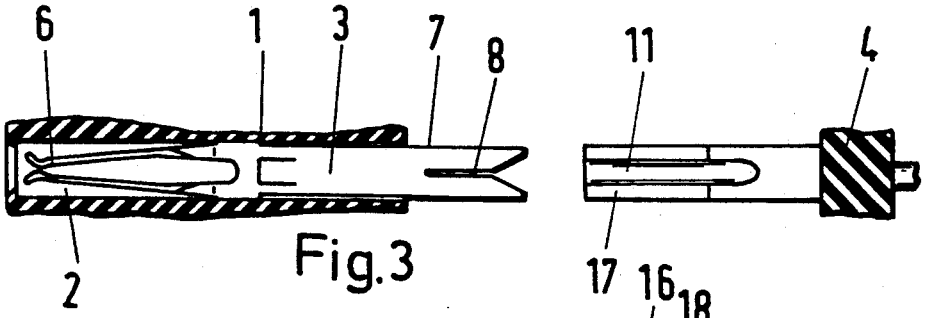
Fig.3
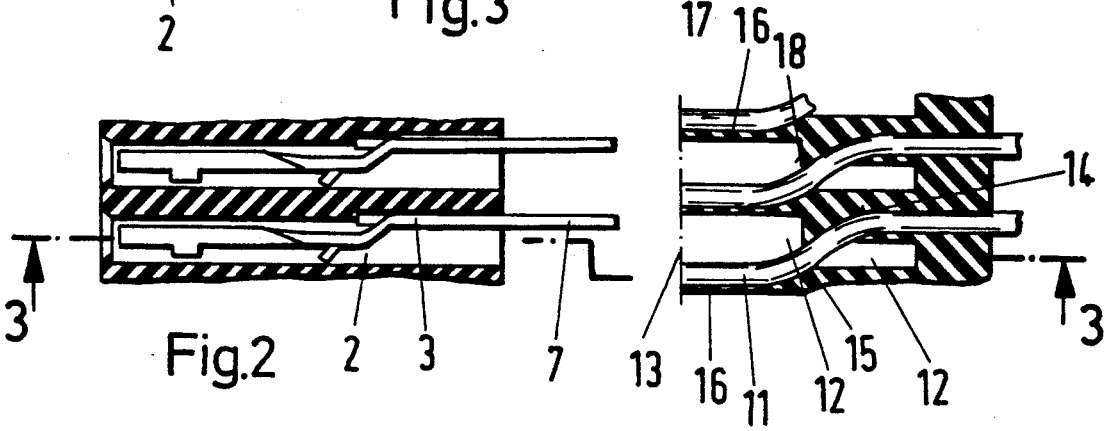
Fig.2
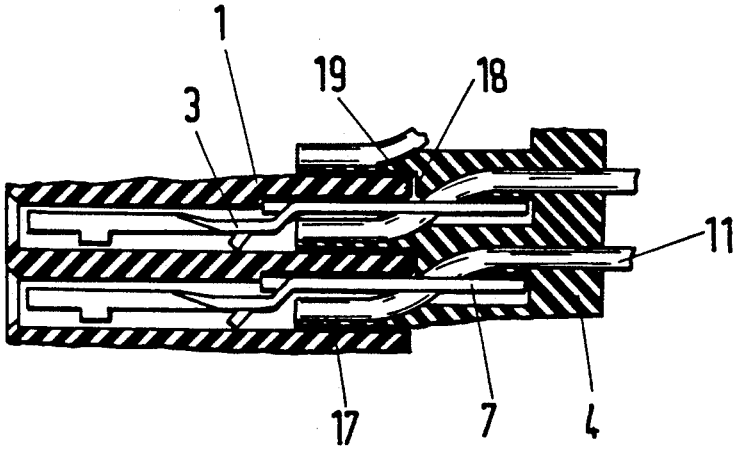
Fig.4
Fig.5
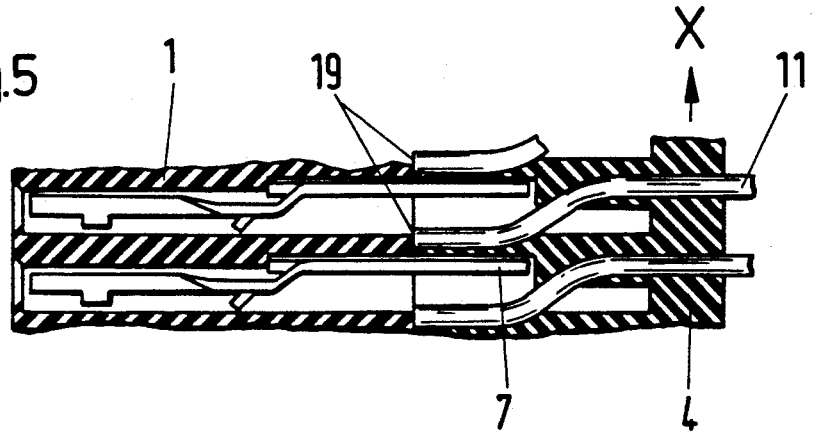

ELECTRICAL CONNECTOR

BACKGROUND OF THE INVENTION

The invention relates to an electrical connector for connecting insulated electrical conductors, preferably electrical plug and socket connectors, with contact elements disposed in recesses or chambers of a carrying base/insulator, the contact elements being provided at least at one end with a cutting and insulation displacement connection for connection to a conductor and the conductors being taken into the connector in the axial direction, relative to the longitudinal dimension of the contact elements or the chambers.

For such connectors it is necessary to force the electrical conductors together with their insulation into the cutting and insulation displacement connections with penetration of the insulation and electrical contacting between the metal conductor and the respectively assigned connecting element. At the same time, the electrical conductors should be introduced in the axial direction into the carrying or insulating base of the connector for the purpose of enabling several connectors to be disposed tightly next to one another.

The EP 0 102 156 B1 discloses a connecting device, for which a contact element with a cutting and insulation displacement connection is disposed in a carrying base and for which the conductor, which is to be connected, is introduced in the axial direction, based on the longitudinal dimension of the contact element, into the contact element or the carrying base. After the conductor is introduced, pressure is then exerted onto the front end of the contact element, by means of which a rear region of the contact element, into which the conductor is introduced, is folded up.

As a result of this folding, the cutting edges of the folded contact element side walls penetrate the insulation of the conductor and achieve electrical contact with the metallic part of the conductor. However, for this connection device, which on the whole is satisfactory, a contact element of sophisticated design is necessary in order to ensure satisfactory contacting.

OBJECTS AND SUMMARY OF THE INVENTION

It is therefore an object of the invention to develop an electrical connector of the initially named type in such a manner, that the cutting and insulation displacement connection of the contact element can be designed as simply as possible, so that the contact element can be produced inexpensively as a mass-produced article and that the axially introduced conductors can be pressed as simply as possible, yet securely, into the cutting and insulation displacement connection, reliable contacting with the contact elements being assured.

This objective is accomplished owing to the fact that the electrical conductors can be pressed by means of a pressure part into the cutting and insulation displacement connections of the contact elements, that the pressure part is constructed as a conductor guiding element and provided with guiding boreholes, which are aligned axially with respect to the contact elements of the connector and in which conductors can be enclosed, that the guiding boreholes end in recesses disposed on the underside of the conductor guiding element, that the ends of the guiding boreholes change over into deflecting inclinations for the conductors that have been introduced, that a further deflecting inclination is disposed in each case on the sides of the recesses opposite to the deflecting inclinations, these deflecting inclinations, viewed in axial direction, being disposed offset to the first deflecting inclinations, that the conductor guiding element is provided with projections, which can be pushed into the chambers of the insulator with the therein disposed contact elements, and that a stop at the conductor guiding part, which comes up against an edge of the insulator upon sufficient insertion, limits the depth of insertion of the conductor guiding element or its projections, the conductors, guided obliquely through the recesses by the deflections, being forced into the cutting and insulation displacement connections of the contact elements.

The advantages achieved with the invention consist especially therein that the cutting and insulation displacement connection of the contact elements is constructed extremely simply. After the upper and lower part of the insulator are pressed together, reliable contacting between the contact element and the conductor, introduced into an opening of the upper part of the insulator, is achieved. Moreover, the connected conductors then protrude in axial direction out of the insulator and the packing density of connectors, disposed next to one another, is not affected by the conductors that have been connected. An additional advantage can be seen therein that, due to the inclined course of the conductors through the deflections in the upper part of the insulator, the upper part acts in a stress-relieving manner on the conductors after the upper and lower parts are pressed together. A further advantage lies therein that the space required to fit the contact elements is not affected by the cutting and insulation displacement connection of the contact elements extending flat in the axial direction of the contact elements. The contact elements in a multipin connector can thus be disposed extremely close next to one another.

BRIEF DESCRIPTION OF THE DRAWINGS

An embodiment of the invention is described in greater detail in the following and shown in the drawing, in which FIG. 2 shows a side view of contact chambers of the plug and socket connector of FIG. 1 in section, FIG. 3 shows the plan view of the contact chamber of FIG. 2 in section, FIG. 4 shows the side view of an assembled plug and socket connector in partial section, FIG. 5 shows the side view of a modified preinstalled plug and socket connector in partial section.

DETAILED DESCRIPTION OF THE PREFERRED EMBODIMENTS

Figure 1:
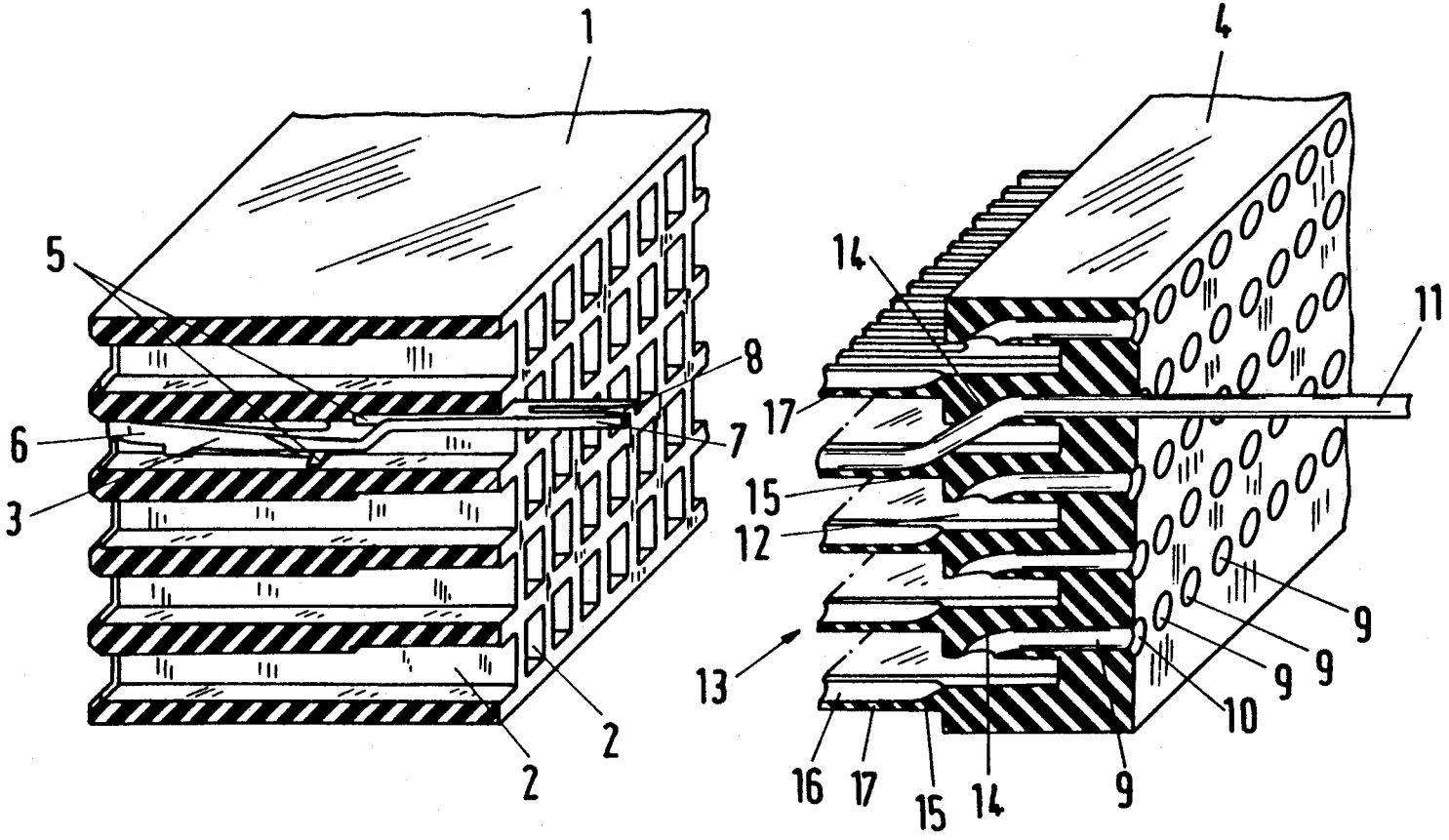
FIG. 1 shows a perspective view of a plug and socket connector in a pulled apart representation in section.

The plug and socket connector, shown in FIG. 1, consists essentially of a carrying base 1, which is provided with chambers 2, in which the contact elements 3 are disposed, as well as of an upper/pressure part, which is constructed as a conductor guiding element 4.

The contact elements, of which only one is shown here for the sake of greater clarity, are held in the chambers by appropriately disposed locking means 5 and provided at their front ends 6 with a socket connection for connecting them with a corresponding plug connector. At the rear end, the contact elements are constructed flat and provided with a cutting and insulation displacement connection, which is formed essentially by the slot 8. The cutting and insulation displacement connection protrudes from the carrying base 1.

The upper part/pressure part, which is constructed as conductor guiding element 4, is provided with guiding boreholes 9, into the funnel-shaped inlets 10 of which the conductors 11, which are to be connected, can be pushed. The guiding boreholes, running axially in the direction of the contact elements 3, end in a recess 12, which is molded from the direction of the underside 13 of the conductor guiding element. The transition from the guiding boreholes to the recesses is provided with a deflecting inclination 14. A conductor 11, pushed into a guiding borehole 9, is deflected by this deflecting inclination in such a manner, that it extends obliquely through the recess 12.

At the wall of the recess 12 opposite to the deflecting inclination 14, a deflecting inclination 15 is once again provided, which deflects a conductor, striking it as it is being pushed in, once more in the axial direction, the conductor being held in a guiding trough 16 in a pin-like projection 17 adjacent to the deflecting inclination 15. Viewed in axial direction, the two deflecting inclinations 14, 15 are disposed offset to one another, so that a pushed-in conductor 11 is guided obliquely through the recess 12.

In FIGS. 2 and 3, sections through contact chambers of the plug and socket connector are shown in order to illustrate details.

To connect the conductors 14 to the contact elements 3 of the plug and socket connector, the conductors are first of all pushed into the guiding boreholes 9 of the conductor guiding element 4, until they, after having been deflected, protrude slightly from the underside 13. Subsequently, the protruding ends of the conductors are cut off, so that they terminate flush with the underside 13. The conductor guiding element 4, so pre-produced (see FIG. 2), is then placed on the carrying base 1 and the projections 17 are pushed into the contact chambers 2, the protruding cutting and insulation displacement connection 7 of the contact elements dipping into the recesses 12 and the conductors, guided obliquely through the recesses, are pressed into the slots 8 when the carrying base 1 and the conductor guiding element 4 are compressed. At the same time, the insulation of the conductors is split in a known manner and the metallic conductor core is connected electrically with the contact element.

A shoulder 18 on the conductor guiding element, which comes to rest at a stop surface 19 on the carrying base when the two parts are pressed together, limits the depth of insertion of the projections 17 or of the conductor guiding element, as shown in FIG. 4. In the end position, that is, after the conductor has been connected, the carrying base and the conductor guiding element are held together by locking means, the details of which are not shown here. Due to the deflections of the conductors in the conductor guiding element, the latter acts in a stress-relieving manner on the conductor emerging axially from the conductor guiding element.

A modified construction of the plug and socket connector is shown in FIG. 5. Provisions are made here so that the conductor guiding element 4 is connected in a pre-installed position with the carrying base 1. This pre-installed position of the conductor guiding element is shown in FIG. 5. In this position, the conductors 11, which have been pushed into the guiding boreholes, come up against the stop surface 19 (upper side of the carrying base 1) towards the end of the conductor-insertion process. Because the conductor comes up against the stop surface, the user has no problems in recognizing when the conductor has been pushed in far enough. After all conductors, which are to be connected, have been pushed in, the conductor-connecting element is shifted in the direction of arrow X, until the projections 17 are above or in front of the contact-chamber openings and are pushed into the contact chambers when pressure is exerted in the axial direction on the conductor guiding element. The electrical connection of the conductor with the contact elements or the cutting and insulation displacement connection 7 is then made once again as already described above and, when the connection has been made, the position of the parts for this modified installation arrangements for the plug and socket connector also corresponds to the representation shown in FIG. 4.

Figure 6:
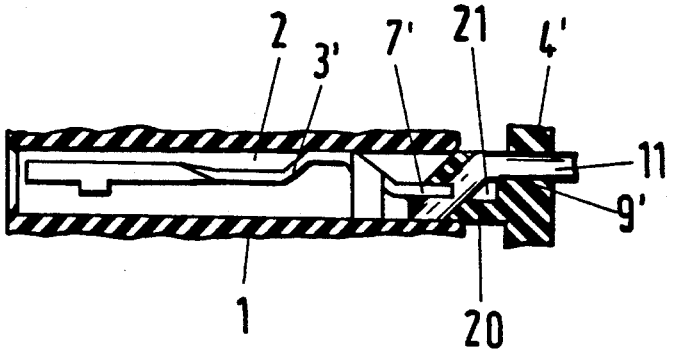
FIGS. 6 to 9 show the side views of a contact chamber of further modified plug and socket connectors in partial section.

FIG. 6 shows a contact chamber 2 with a modified contact element 3' as well as with a modified contact guiding element 4'. The conductor guiding element is provided here with pin-shaped projections 20, through which the guiding boreholes 9' extend. Moreover, the cross-section of the projections corresponds to the cross-section of the contact chambers 2 in their upper region, so that the projections can be pushed into the contact chambers.

The guiding boreholes 9', coming axially into the conductor guiding element, run at an angle of about 45° towards the end of the projections, so that a conductor, pushed into the borehole, is guided obliquely through the respective projection, before it finally emerges from the side of the projection. After the conductors are pushed into the conductor guiding element, the ends of the conductors, which protrude from the projections, are optionally cut off flush. A transverse slot 21 in the projections 20 enables the cutting and insulation displacement connections 7' of the contact elements to dip in when the carrying base 1 and the conductor guiding elements 4' are compressed. While the projections are being pushed in, the conductors are pressed into the cutting and insulation displacement connections and the electrical connection is produced between the conductors and the contact elements. With this construction also, locking means, the details of which are not shown, cause the carrying base and the conductor guiding element to be held together after the conductor is connected.

Figure 7:
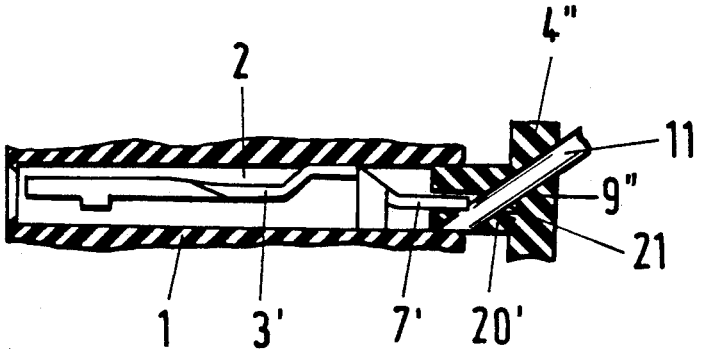

A further modification of the conductor guiding element, described above, is shown in FIG. 7. Provisions are made here so that the guiding boreholes 9'' are brought into the conductor guiding element 4'' at an angle of about 45° and run in a straight line through the projection 20'.

Figure 8:
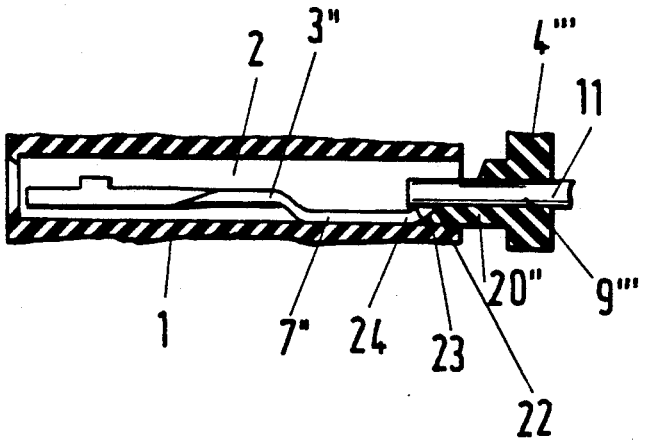
Figure 9:
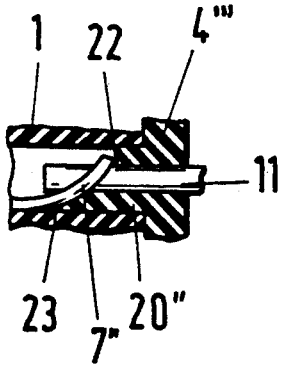

A further modification of the connector is shown in FIGS. 8 and 9 in partial section in a contact chamber 2. The conductor guiding element 4''' is also provided here with a pin-like projection 20''. However, the end of the projection 20'' is provided with an inclined surface 22, so that a point 23 is formed there. For this construction, the guiding boreholes 9''' are aligned precisely axially to the direction of the contact elements 3'' and the ends 24 of the cutting and insulation displacement connections 7'' are bent up slightly, so that the point 23 can grip behind the cutting and insulation displacement connection 7" of the contact elements 3".

To install or connect them, the conductors are first pushed through the guiding boreholes into the conductor guiding element, until they protrude a little from the inclined surface 22 of the projection 20". Subsequently, the projections are pressed into the upper ends of the contact chambers, the points 23 gripping behind the cutting and insulation displacement connections 7" and, as the projections continue to be pressed in, bending these cutting and insulation displacement connections 7" up over the inclined surface and over the end of the respective conductor. At the same time, the conductor ends then reach the slots of the cutting and insulation displacement connections and are connected electrically with the contact elements. The pushing in of the projections of the conductor guiding element is ended when the conductor guiding element comes up against the upper side of the carrying base 1, the two parts being then held together here also by locking means, which are not shown in detail.

We claim:

1. An electrical connector for connecting insulated electrical conductors, comprising:

a carrying base/insulator including:

a plurality of chambers, each extending in a longitudinal direction, contact elements disposed in said chambers, each said contact element having one end with a cutting and insulation displacement connection for connection to an electric conductor, and a stop edge; and pressure part means for pressing the electrical conductors into the cutting and insulation displacement connections of the contact elements, said pressure part means being formed by a conductor guiding element including:

an underside, recesses disposed on the underside of the conductor guiding element, guiding boreholes which are axially aligned with respect to the contact elements and into which the conductors can be pushed, said guiding boreholes including first deflecting inclinations at an end thereof which provide a deflecting inclination for the electrical conductors therethrough and which terminate in said recesses, a second deflecting inclination disposed at a side of each recess opposite to a respective first deflecting inclination and axially offset therefrom, such that said conductors are guided obliquely through said recesses by means of said first and second deflecting inclinations and turned so that axes of said conductors are substantially parallel to said longitudinal directions when the conductors are pressed into the cutting and insulation displacement connections of the contact elements, projections which are adapted to be pushed into said chambers containing said contact elements, and stop means for limiting the depth of insertion of the conductor guiding element into the carrying base/insulator by abutting against said stop edge of said carrying base/insulator upon insertion of said conductor guiding element by a predetermined amount into said carrying base/insulator.

2. An electrical connector according to claim 1, wherein each said cutting and insulation displacement connection includes a portion that protrudes from said carrying base/insulator and said portion is formed with slot means for receiving and cutting away insulation from a respective conductor.

3. An electrical connector 1, wherein said stop means includes at least one stop shoulder formed on said conductor guiding element.

4. An electrical connector according to claim 1, wherein said conductor guiding element is held in a pre-assembled state in said carrying base/insulator so as to be laterally shiftable therein, said projections being adapted to be pushed into said chambers of the carrying base/insulator after said conductor guiding element has been laterally shifted in said carrying base/insulator.

5. An electrical connector according to claim 4, wherein said stop edge is formed by an end surface of said carrying base/insulator against which said conductors abut, after introduction in said guiding boreholes and deflection by said first and second deflecting inclinations.

6. An electrical connector for connecting insulated electrical conductors, comprising:

a carrying base/insulator including:

a plurality of chambers, each extending in a longitudinal direction, contact elements disposed in said chambers, each said contact element having one end with a cutting and insulation displacement connection for connection to an electric conductor, each said cutting and insulation displacement connection having a slot; and pressure part means for pressing the electrical conductors into the cutting and insulation displacement connections of the contact elements, said pressure part means being formed by a conductor guiding element including:

pin-shaped projections adapted to be pushed into the chambers of the carrying base/insulator, each said projection having an inclined surface which terminates in a line surface, each said line surface gripping behind a cutting and insulation displacement connection of a respective said contact element as the projections are pushed into the chambers and, as insertion of said projections continues, each said projection presses the cutting and insulation displacement connection of the respective said contact element against a respective axially aligned conductor so as to push the respective conductor into the slot of the cutting and insulation displacement connection, and guiding boreholes which are axially aligned with respect to the contact elements and into which the conductors can be pushed, said guiding boreholes extending through said pin-shaped projections.

7. An electrical connector according to claim 6, wherein said carrying base/insulator includes a stop edge; and said conductor guiding element includes stop means for limiting the depth of insertion of the projections into the carrying base/insulator by abutting against said stop edge of said carrying base/insulator upon insertion of said conductor guiding element by a predetermined amount into said carrying base/insulator.

8. An electrical connector for connecting insulated electrical conductors, comprising:

a carrying base/insulator including:

a plurality of chambers, each extending in a longitudinal direction, contact elements disposed in said chambers, each said contact element having one end with a cutting and insulation displacement connection for connection to an electric conductor; and pressure part means for pressing the electrical conductors into the cutting and insulation displacement connections of the contact elements, said pressure part means being formed by a conductor guiding element including:

pin-shaped projections adapted to be pushed into the chambers of the carrying base/insulator, guiding boreholes which are essentially axially aligned with respect to the contact elements and into which the conductors can be pushed, said guiding boreholes extending through said pin-shaped projections and having a deflection portion near an end of each said projection which is angled by about 45 degrees from said longitudinal direction, and each said projection having a recess which receives a respective cutting and insulation displacement connection when said projections are pushed into said chambers such that said cutting and insulation displacement connections penetrate into said guiding boreholes and cut through insulation on said conductors so as to electrically connect the conductors with said contact elements.

9. An electrical connector according to claim 8, wherein said carrying base/insulator includes a stop edge; and said conductor guiding element includes stop means for limiting the depth of insertion of the projections into the carrying base/insulator by abutting against said stop edge of said carrying base/insulator upon insertion of said conductor guiding element by a predetermined amount into said carrying base/insulator.

10. An electrical connector for connecting insulated electrical conductors, comprising:

a carrying base/insulator including:

a plurality of chambers, each extending in a longitudinal direction, contact elements disposed in said chambers, each said contact element having one end with a cutting and insulation displacement connection for connection to an electric conductor; and pressure part means for pressing the electrical conductors into the cutting and insulation displacement connections of the contact elements, said pressure part means being formed by a conductor guiding element including:

pin-shaped projections adapted to be pushed into the chambers of the carrying base/insulator, guiding boreholes which are essentially axially aligned with respect to the contact elements and into which the conductors can be pushed, said guiding boreholes extending through said pin-shaped projections, and said guiding boreholes each being angled by about 45 degrees from said longitudinal direction, and each said projection having a recess which receives a respective cutting and insulation displacement connection when said projections are pushed into said chambers such that said cutting and insulation displacement connections penetrate into said guiding boreholes and cut through insulation on said conductors so as to electrically connect the conductors with said contact elements.

11. An electrical connector according to claim 10, wherein said carrying base/insulator includes a stop edge; and said conductor guiding element includes stop means for limiting the depth of insertion of the projections into the carrying base/insulator by abutting against said stop edge of said carrying base/insulator upon insertion of said conductor guiding element by a predetermined amount into said carrying base/insulator.

* * * * *